United States Patent [19]

Bunkoczy

[11] Patent Number: 4,790,472

[45] Date of Patent: Dec. 13, 1988

[54] METHODS FOR MANUFACTURING A TOROIDAL PRESSURE VESSEL

[75] Inventor: Bela Bunkoczy, Chandler, Ariz.

[73] Assignee: Allied Signal Inc., Morris Township, Morris County, N.J.

[21] Appl. No.: 13,219

[22] Filed: Feb. 6, 1987

Related U.S. Application Data

[60] Continuation-in-part of Ser. No. 767,228, Aug. 16, 1985, abandoned, which is a division of Ser. No. 659,606, Oct. 11, 1984, Pat. No. 4,561,476.

[51] Int. Cl.[4] ..... B23K 31/02; B23K 33/00

[52] U.S. Cl. ..... 228/171; 228/184; 29/463; 220/75; 220/76

[58] Field of Search ..... 228/171, 184; 29/2.1, 29/412, 417, 463; 220/75, 76, 5 A, 3

[56] References Cited

U.S. PATENT DOCUMENTS

| | | | |
|---|---|---|---|
| 2,136,474 | 11/1938 | Straty | 220/465 |
| 3,550,253 | 12/1970 | Frey | 228/170 |
| 3,579,806 | 5/1971 | Huberdeau | 29/463 |
| 3,807,009 | 4/1974 | Ostbo | 29/463 |
| 3,815,534 | 6/1974 | Kneusel | 220/207 |
| 4,162,569 | 7/1979 | Damusis | 29/417 |
| 4,318,491 | 3/1982 | Nelson | 220/1 B |

*Primary Examiner*—Nicholas P. Godici
*Assistant Examiner*—Samuel M. Heinrich
*Attorney, Agent, or Firm*—Terry L. Miller; James W. McFarland

[57] ABSTRACT

A toroidal pressure vessel comprises two annular, complementarily formed axial sections which are intersecured along a duality of annular joint lines that circumscribe and are mutually offset along the axis of the toroid. The axial sections are formed by machining a pair of end portions removed from a length of thick-walled metal tubing.

14 Claims, 2 Drawing Sheets

METHODS FOR MANUFACTURING A TOROIDAL PRESSURE VESSEL

This application is a continuation-in-part, of application Ser. No. 767,228, filed Aug. 16, 1985.

BACKGROUND OF THE INVENTION

The present invention relates generally to pressure vessels, and more particularly provides a uniquely contructed two-piece, axially sectioned toroidal pressure vessel used to store and supply high pressure air utilized in various pneumatic control systems.

Conventional pneumatic control systems employ as their motive force a supply of high pressure air contained in a storage vessel which is operatively connected to the various air-driven components of the system through a pressure reduction system that functions to flow a regulated quantity of substantially lower pressure air to the driven components. Depending upon the space and weight limitations of the system, a wide variety of pressure vessel configurations may be used.

Particularly in space-limited applications, the toroidal shape has proven to be a very desirable storage vessel configuration because it permits various system structure, such as wiring and mechanical linkage, to be routed through the toroid's central opening. Thus, for example, in applications where the system must fit within a cylindrical housing of a predetermined inner diameter, a toroidal storage vessel of essentially the same overall diameter may be coaxially disposed within the housing at any point along its length and still permit the unimpeded interconnection of components positioned at opposite ends of the vessel.

Despite the desirability of its shape in many applications, however, the toroidal pressure vessel has heretofore presented several very difficult manufacturing problems which have significantly limited its use in high pressure air supply applications. It is to these problems that the present invention is directed.

The conventional method of fabricating a toroidal pressure vessel is to provide a section of metal tubing of an appropriate length and wall thickness, bend the tube section around a mandrel and butt weld the opposite tube ends together. Unfortunately, this seemingly simple and straightforward manufacturing technique is replete with inherent disadvantages and intricacies.

For example, it is well known that the area of maximum wall stress in an internally pressurized toroidal body occurs around the annulus of its radially innermost wall section. Thus, to equalize the pressure-induced stress around its cross-sectional area the radially inner wall of the vessel must be significantly thicker than its radially outer wall, with an appropriate degree of thickness tapering between these two extremes. Such equalization of wall stress is desirable, of course, because for a given internal design pressure and storage volume it minimizes the weight and external volume of the vessel. In the tube-bending method of forming the toroid, however, this desirable minimization is, as a practical matter, nearly impossible. Although, as the tube is bent there is a natural thickening of the resulting radially inner wall section, and a thinning of the radially outer wall section, the resulting thickness ratio (which, among other things, is dependent upon the tube section length) is nearly always far from optimal.

This unavoidable deficiency may be partially overcome by the relatively expensive and time-consuming expedient of custom manufacturing a tubing section having an eccentric bore. This is typically accomplished by drilling an axially offset bore in a section of solid cylindrical metal bar stock. The thicker wall portion of the eccentric tubing is then positioned against the mandrel prior to the bending of the tube into the requisite circular shape. As might be imagined, both the drilling and bending steps must be carried out with extreme care and precision to achieve an acceptable approximation of the optimum vessel cross-section. Not only must these steps be carefully performed, but precise design allowances must be made for the unavoidable wall thickness changes which occur during the bending process. In short, what would initially appear to be a straightforward design procedure in many instances turns out to be a time-consuming trial and error process with a concomitantly high scrap rate.

Another problem associated with the conventional tubebending method is that it is simply not feasable in the case of small-diameter, high pressure toroidal storage vessels. As a specific example, for an internal design pressure of 10,000 psi the lower internal diameter limit for the toroid is approximately four inches. At and below this diameter limit, metals strong enough to withstand the design pressure are not malleable enough to withstand the bending. Additionally, at these small toroidal diameters it is extremely difficult to properly butt weld the facing tube ends because of the very limited work space within the toroid's central opening.

Finally, because of the unavoidable imprecision as to resulting wall thicknesses in the finished pressure vessel an unnecessarily high safety factor must be utilized to assure that the design pressure limitation may be safely maintained. This necessity, of course, adds weight, external volume and expense to the finished vessel. Additionally, it is often a design requirement that the vessel have a predetermined burst location. Because of the wall thickness imprecision in the tube-bending method, however, this design requirement has also been difficult to meet.

Accordingly, it is an object of the present invention to provide a toroidal pressure vessel, and associated manufacturing methods therefor, which eliminates or minimizes above-mentioned and other problems and disadvantages associated with conventional storage vessels of toroidal configuration.

SUMMARY OF THE INVENTION

Utilizing principles of the present invention, in accordance with a preferred embodiment thereof, a two-piece, axially sectioned toroidal pressure vessel is provided, the two axial sections being intersecured and sealed along a duality of annular joint lines which encircle and are mutually offset along the axis of the toroid.

According to a feature of the invention, the annular axial sections of the vessel are formed by machining a pair of blanks resulting from the removal of two end portions of a length of thick-walled metal tubing. During the machining process each of the annular sections is given a nonuniform cross-sectional wall thickness in a manner such that the assembled toroidal vessel will have an essentially equal internal pressure-induced wall stress level around the entire periphery of its cross-section. Additionally, each of the annular sections is configured to have axially offset radially inner and outer annular edge portions. In these assembled pressure vessel the inner and outer edge portions of the annular sections are in an axially overlapped, abutting relationship and define the axially offset joint lines of the vessel. The complementary annular sections are welded along these joint lines.

Still another feature of the invention provides axially and radially extending engagement surfaces on each of the edge portions of the annular sections. These engagement surfaces are cooperative to define a bell-and-spigot type joint for the annular sections of the toroid. Accordingly, when the engagement surfaces of the sections are engaged, the sections are self-fixturing in a singular relative radial and axial position. Welding of the sections at the joint lines is thus facilitated by the cooperative nature of the engagement surfaces.

According to another feature of the invention, the torodial pressure vessel is provided with an outlet fitting which is welded to one of the annular vessel sections, along the inner surface thereof, prior to the intersecuring of the two sections.

In an alternative embodiment of the invention a depression is formed in the inner surface of one of the annular sections, prior to assembly of the vessel, to provide the assembled vessel with a precisely located, predetermined burst area.

DETAILED DESCRIPTION

Figure 1:
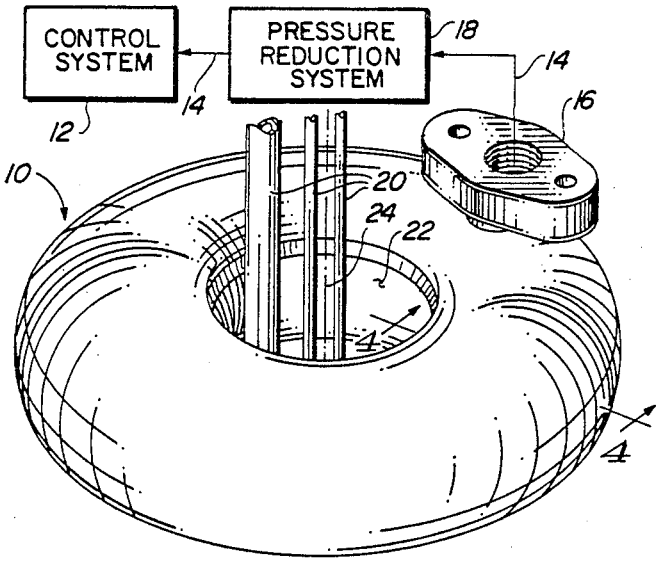
FIG. 1 is a perspective view of a two pieces, axially sectioned toroidal pressure vessel which incorporates principles of the present invention and is utilized to furnish high pressure supply air to a pneumatically operated control system schematically illustrated in FIG. 1.
Figure 8:
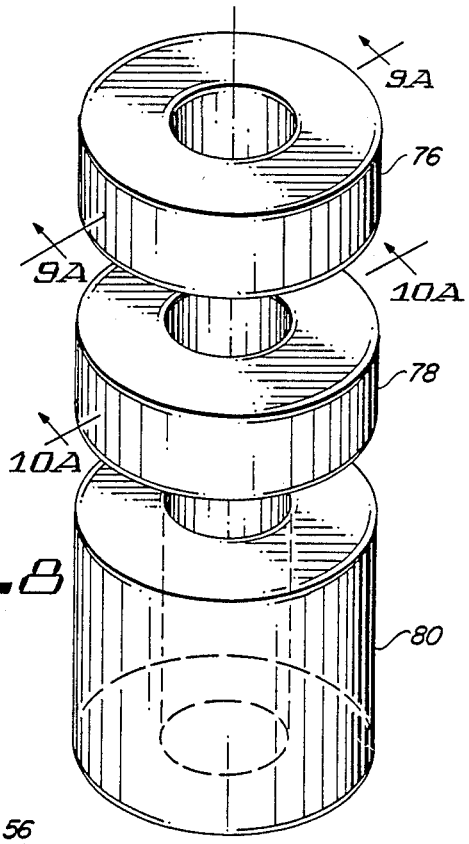
FIG. 8 is a reduced scale perspective view of a length of thick-walled metal tubing from which a pair of annular end portions have been removed for use as blanks machinable to form the upper and lower axial sections of the pressure vessel.

As illustrated in FIG. 1, the present invention provides a toroidal pressure vessel 10 which is utilized to store a supply of high pressure air (or other gas) used to operate the various components, such as valves, motors and the like, of a pneumatic control system 12. The high pressure supply air flows to the system 12 via a conduit 14 which is connected to an outlet fitting 16 mounted on the vessel 10. A conventional pressure reduction system 18, interposed in the conduit 14 between the control system 12 and the fitting 16, functions to provide a regulated flow of motive air to the control system at a predetermined pressure substantially less than the air pressure within the vessel 10.

In a variety of pneumatic control system applications the toroidal configuration of the vessel 10 is particularly convenient and advantageous because it permits various structure 20, such as pneumatic piping, electrical wiring and the like, to be passed through the central opening 22 of the toroid in a direction generally parallel to its axis 24.

As will be seen, the pressure vessel 10 is of a unique construction which affords it several very desirable advantages over conventional toroidal pressure vessels which are formed by bending a length of tubing around a circular mandrel and then butt welding the opposite ends of the bent tube.

STRUCTURE AND ASSEMBLY OF THE PRESSURE VESSEL 10

Figure 2:
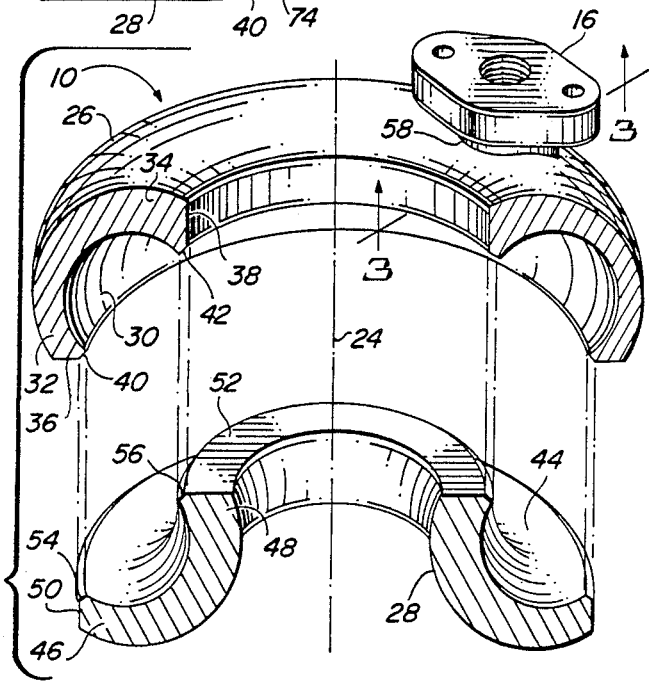
FIG. 2 is a sectioned, exploded perspective view of the pressure vessel of FIG. 1.
Figure 5:
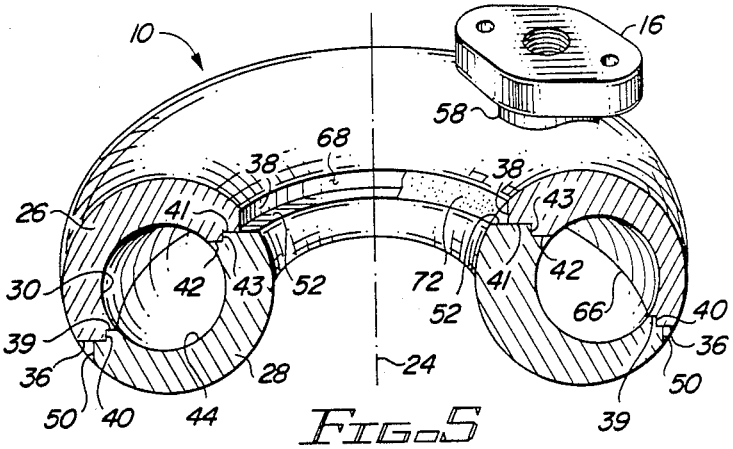
FIG. 5 is a sectioned perspective view through the pressure vessel of FIG. 1 with portions of the upper and lower annular weld joints being broken away for purposes of illustration.

Referring now to FIG. 2, the pressure vessel 10 is of a two-piece, axially sectioned metal construction comprising an upper annular member or section 26, to which the outlet fitting 16 is secured, and a lower annular member or section 28. As can be seen in FIG. 5, the axial sections 26, 28 are complementarily shaped (somewhat C-shaped in transverse section) to define the hollow, generally circularly cross-sectioned toroidal configuration of the vessel 10 when the sections are intersecured (in a manner subsequently described).

The upper section 26 (FIG. 2) has an arcuate cross-section which defines a concave, annular inner surface 30 and terminates in an annular, radially outer edge portion 32, and an annular, radially inner edge portion 34 which is axially offset in an upward direction from edge portion 32. Edge portion 32 has an annular, axially downwardly facing end surface 36, while the edge portion 34 has an annular, radially inwardly facing end surface 38. Annular engagement surfaces 39, 40, 41, 42 and 43 are respectively formed on the section 26 at the junctures of surfaces 30, 36 and 30, 38. Surfaces 40 and 43 extend axially, while surfaces 39, 41, and 42 extend radially.

Like its complementarily formed upper section 26, the lower section 28 has an arcuate cross-section which defines a concave, annular inner surface 44 and terminates in an annular, radially outer edge portion 46, and an annular, radially inner edge portion 48 which is axially offset in an upward direction from edge portion 46. Edge portion 46 has an annular, radially outwardly facing end surface 50, while the edge portion 48 has an annular, axially upwardly facing end surface 52. Annular engagement surfaces 53, 54, 55, and 56, and 57 are respectively formed on the section 28 at the junctures of surfaces 44, 50 and 44, 52.

Figure 3:
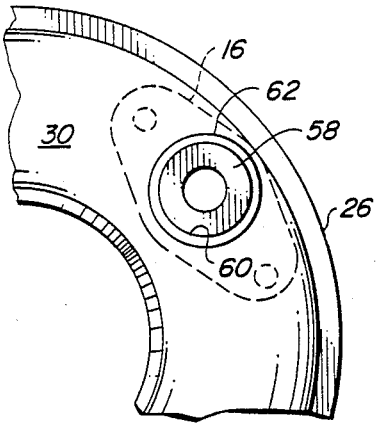
FIG. 3 is an enlarged scale fragmentary cross-sectional view, taken along line 3—3 of FIG. 2, through the upper annular pressure vessel section, and illustrates the interior weld joint used to affix an outlet fitting thereto.

In assembling the pressure vessel 10, the outlet fitting 16 is first secured to the upper vessel section 26. Fitting 16 (FIG. 3) has a hollow cylindrical base or neck portion 58 which is inserted axially into a circular opening 60 formed through the wall of section 26. With the fitting neck 58 thus inserted, it is secured to section 26 by an annular weld bead 62 formed along the interior surface 30 around the juncture of the neck 58 and the opening 60.

The ability to make this interior weld arises from the axially split construction of the vessel 10 an presents a distinct advantage over conventional bent tube toroidal vessels. Specifically, in such conventional vessels the outlet fitting can be welded to the vessel body only around its outer surface due to the impracticability (and, in the case of small diameter tubing, the impossibility) of inserting welding apparatus into the tubing. Particularly in the case of relatively thick-walled tubing, it is often very difficult to form an exteriorly-applied weld joint which extends through to the inner surface of the tubing to thereby form a weld joint whose strength is maximized.

In contrast, the present invention affords the opportunity for the fitting's weld joint to emanate from the pressure vessel's interior surface. In the case of relatively thick-walled vessel construction this interior fitting weld may be supplemented by an exterior surface weld (not shown in the drawings), to thereby assure the desired complete exterior-to-interior surface weld penetration which is often unachievable in conventional compact vessel construction.

Figure 4:
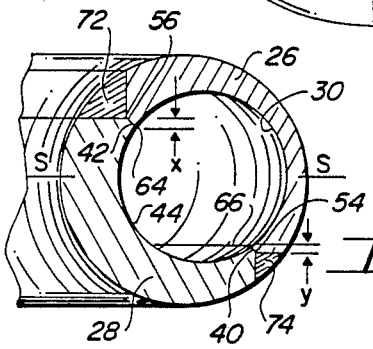
FIG. 4 is an enlarged cross-sectional view taken through the pressure vessel along line 4—4 of FIG. 1.

Referring now to FIGS. 4 and 5, after the outlet fitting has been welded to the upper section 26, the two sections 26, 28 are positioned against one another so that the annular engagement surfaces pairs 36-54, 39-56, 40-55, 41-52, 42-56, and 43-57 are brought into abutment around their facing peripheries. This contiguous positioning of the engaging surfaces precisely aligns the ends of the inner section surfaces 30, 44 and creates in the vessel 10 axially offset joint lines 64 and 66, joint line 64 being positioned radially inwardly of joint line 66. As may best be seen in FIG. 5, the abutment of these facing surface pairs also respectively brings into precise alignment the annular inner ends of the end surfaces 38, 52 and 36, 50. The cooperating engagement surfaces will be seen to define a bell-and-spigot type joint at each of the edge portion pairs 32-46, and 34-48. As a result, the sections 26,28 are disposed in a singular axial and radial position relative one another due to engagement of the bell-and-spigot joints so defined. The aligned end surface pairs 38, 52 and 36,50 respectively define annular, right-angled weld channel 68 which circumscribes the axis 24 near the upper end of the vessel 10, and an annular, right-angled weld channel 70 which circumscribes the axis 24 near the lower end of the vessel 10.

Figure 6:
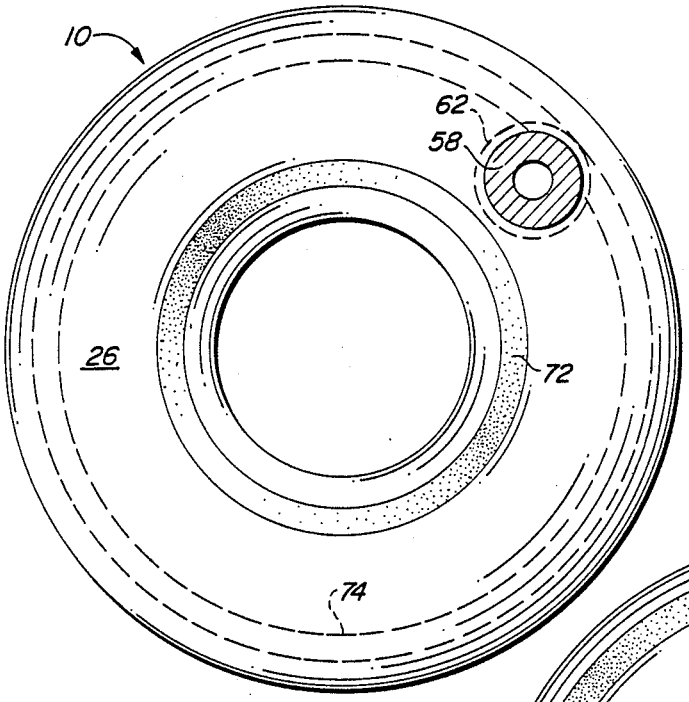
FIG. 6 is an enlarged scale top view of the pressure vessel of FIG. 1 with an upper portion of the outlet fitting being cut away.
Figure 7:
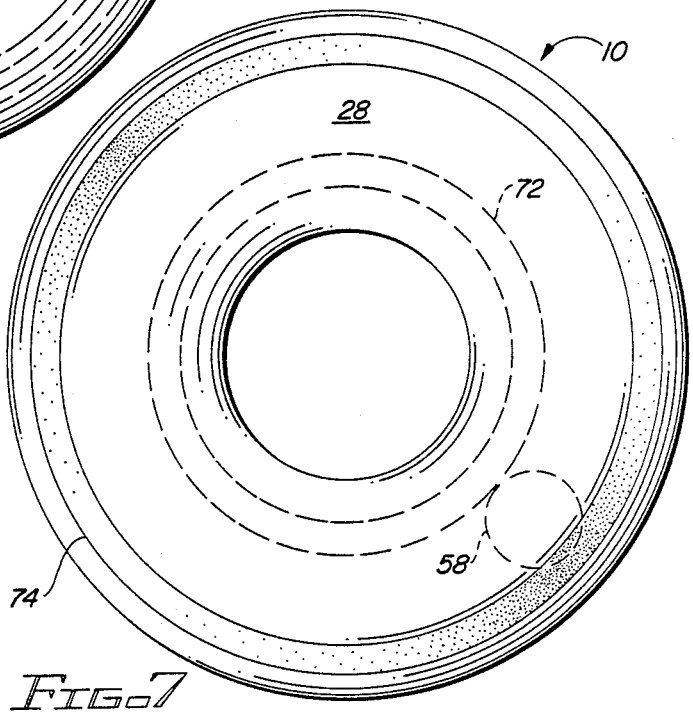
FIG. 7 is an enlarged scale bottom view of the pressure vessel of FIG. 1.

With the two axial sections aligned in this manner the construction of the toroidal pressure vessel is completed by forming conventional weld beads 72, 74 (FIGS. 5, 6 and 7) along the axially offset joint lines 64, 66 within the weld channels 68, 70. Because of the unique cooperation between the engagement surfaces areas 36-54, 39-56, 40-55, 41-52, 42-56, and 43-57 the welding of the vessel is significantly easier than that required in conventional tube-formed toroidal vessels. Specifically, as may best be seen in FIG. 4, upon the interengagement of the engagement surfaces, the upper and lower vessel sections 26, 28 are caused to axially overlap one another around an annular upper area "x", and an annular lower area "y". These axially offset overlapped areas conveniently prevent side-to-side relative shifting of the interengaged sections, thereby holding them in precise alignment during the welding process. As a result, the interengaged sections are self-fixturing to relatively dispose themselves in a singular axial and radial relative position, as illustrated viewing FIGS. 4 and 5. Accordingly, welding of the sections depends less upon the skill of the welding operator, and a weld with consistent melt of the base metal and freedom from voids is more likely to be achieved. Success in the welding process has been shown to approach 100 percent in practicing the invention. Scrap rate in manufacaturing pressure vessels is thus reduced. It will be understood that the welding at joint lines 64,66, in addition to filling the weld channels 68,70, also controllably melts through the parent metal of the sections 26,28 to fuse these sections and obliterate the bell-and-spigot joints therebetween. That is, after welding, the material of edge portions 32-46, and 35-48 is fused and the previously existing joint detail is no longer present.

In addition to this self-alignment feature, the relative positioning and configuration of the axially offset upper and lower annular weld joints permits the vessel 10 to be fabricated in even very small-diameter sizes (i.e., less than 6" outer toroid diameter). This distinct advantage arises from the fact that in welding the sections 26, 28 the welding tool is simply passed around the periphery of the toroid adjacent its opposite ends - the tool need not be inserted any appreciable distance into the toroid's central opening.

In the case of conventional bent-tube vessels, on the other hand, such small diameter vessels are impractical (if not impossible) to make due the necessity of clamping the ends of bent tube together (to keep them from springing apart from one another) and then passing the welding tool completely through and transversely around the very small central toroid opening.

Moreover, the offset weld joints 72, 74 are desirably shifted axially away from the plane "S"—"S" (FIG. 4) of maximum vessel wall stress, the maximum wall stress occurring along the intersection of such plane with the radially innermost vessel wall portion. This, of course, reduces the internal pressure-induced stress on the weld joints. It is important to note that this advantageous feature is impossible to achieve in a bent-tube toroidal vessel since its single butt-weld joint must, of necessity, pass through this plane of maximum wall stress.

Although the illustrated weld beads 72, 74 may be conveniently applied using a conventional arc welding technique, other welding methods may also be employed. For example, an electron beam welding process may be used. Additionally, the axially sectioned construction of the vessel 10 lends itself particularly well to the "inertial welding" method in which the aligned sections are axially pressed together with great force while at the same time being relatively rotated about the axis 24. This causes uniform metal-to-metal fusion around the annular joint lines 64, 66.

FABRICATION OF THE AXIAL SECTIONS 26, 28

As can be seen in the drawings, each of the axial sections 26, 28, as well as the assembled vessel 10, has a nonuniform cross-sectional wall thickness. More specifically, both the sections and the completed vessel have a cross-sectional wall thickness which is greatest at the radially inner periphery, at a minimum at the radially outer periphery, and has an appropriate degree of circumferential tapering between these two thickness extremes.

If this nonuniform thickness configuration is precisely designed into and achieved in the finished toroidal vessel, the result is that the internal pressure-induced wall stress at all points around the cross-sectional periphery of the vessel is essentially equal. For a given size of the vessel such equalized wall stress minimizes the weight and external volume of the toroid, while maximizing its storage volume.

Unfortunately, the attainment of these optimizations is, as a practical matter, nearly impossible in conventional toroidal pressure vessels fabricated from bent tubing. Although as the tubing is bent there is a natural tendency for its radially inner wall section to thicken, and its radially outer wall section to be diminished in thickness, only in isolated instances does the resulting toroidal cross-section approach providing the desired equal internal pressure-induced wall stress in the finished vessel. Even when the tubing is custom formed with an offset bore, such cross-sectional optimization can usually only be approximated.

Figure 9A:
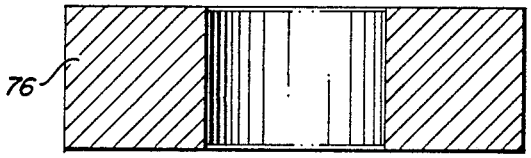
FIGS. 9A and 10A are enlarged scale cross-sectional views taken through the tubing end portions of FIG. 8 along lines 9A—9A and 10A—10A, respectively.
Figure 9B:
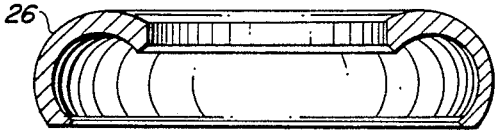
FIGS. 9B and 10B, respectively, are cross-sectional views through the tubing end portions of FIGS. 9A and 10A subsequent to machining thereof to form the upper and lower pressure vessel sections.
Figure 10A:
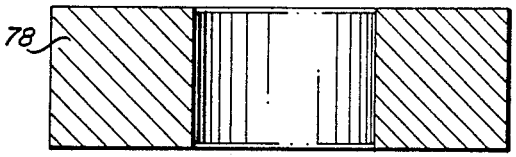
Figure 10B:
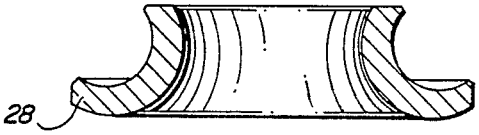

But in the present invention such optimization is readily, precisely and inexpensively achieved by a unique fabrication method which represents an important aspect of the invention. More specifically, with reference to FIGS. 8, 9A, 9B, 10A and 10B, the axial sections 26, 28 are respectively formed from a duality of annular end portions or blanks 76, 78 which have been transversely cut away from a length of thick-walled tubing 80. Each of the rectangularly cross-sectioned blanks 76, 78 (FIGS. 9A and 10A). is then precisely machined, using a numerically controlled lathe, to respectively form the nonuniformly cross-sectioned axial sections 26, 28 depicted in FIGS. 9B and 10B.

Since neither of the sections 26, 28 nor the finished vessel 10, is the end product of any element which must be bent, there is no wall thickness distortion in the vessel. The equal stress, nonuniform wall thickness designed and precisely machined into the sections 26, 28 is maintained in the completed vessel. Additionally, there is no residual bending stress to be compensated for by unnecessarily increased wall thickness in the vessel.

While the previously discussed method of transversely cutting a duality of end portions from a length of thick walled tubing and then precision machining the removed portions to provide the two axial vessel sections is currently preferred, alternate methods could be used to provide the annular blanks, from which the finished sections are fabricated. For example, near net-shaped annular blanks could be formed by conventional casting, or by a vacuum forging process, and then finish machined using a numerically controlled lathe or other precision machining apparatus.

Another problem which is easily and inexpensively solved by the present invention is that of precisely locating the vessel burst area. It is often a design requirement that should a toroidal pressure vessel burst, the burst area must be in a predetermined location along the vessel walls. Because of the vagaries in wall thickness resulting from the conventional tube bending process, predicting or actually positioning the exact burst area is a difficult task - often accomplished only by trial and error as to a particular vessel size.

Figure 11:
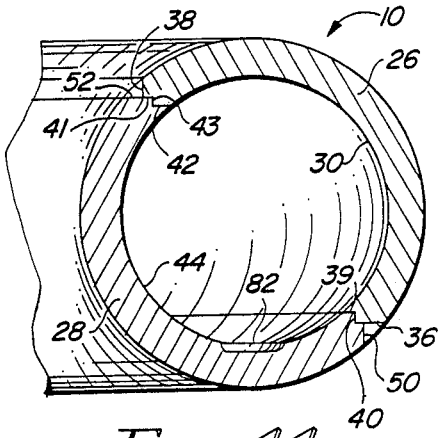
FIG. 11 is a fragmentary cross-sectional view through an alternate embodiment of the pressure vessel which has an interior recess formed therein to provide a predetermined, precisely located burst area in the vessel.

However, in the present invention this problem is solved by forming a small depression 82 (FIG. 11) in the interior surface 44 of section 28 (or surface 30 of section 26, if appropriate) at the desired burst location prior to the welding of the two sections. Since without such depression the pressurized vessel wall stresses are substantially identical around the toroid's cross-sectional circumference, the vessel burst location is precisely positioned at the location of the internal depression 82.

Figure 12:
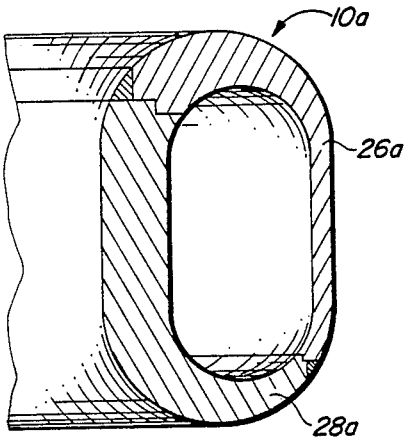
FIG. 12 is a fragmentary cross-sectional view through an alternate embodiment of the pressure vessel in which the axial dimension of its circumferential cross-section is elongated.

It should be noted that while the illustrated vessel 10 is of a circular cross-section, the vessel's cross-section could alternatively be elongated either axially (as in the alternatively configured vessel 10*a* in FIG. 12) or radially if desired. The axial sections, such as 26*a* and 28*a* in FIG. 12, of vessel 10*a* can, of course, be fabricated by the same method variously described for sections 26, 28.

In summary, it can be seen that the present invention provides a toroidal pressure vessel, and associated fabrication methods therefor, which lessens or eliminates each of the previously discussed major problems typically associated with toroidal vessels fabricated by the tube-bending process.

The foregoing detailed description is to be clearly understood as given by way of illustration and example only, the spirit and scope of this invention being limited solely by the appended claims.

What is claimed is:

1. A method of manufacturing a toroidal pressure vessel comprising the steps of:

(a) providing a first annular member configured to define a semi-torodial portion of a hollow toroidal body and having axially offset radially inner and outer annular edge portions and a radially inner wall thickness greater than its radially outer wall thickness;

(b) providing a second annular member configured to define the balance of said toroidal body and having axially offset radially inner and outer annular edge portions and a radially inner wall thickness greater than its radially outer wall thickness;

(c) providing complementary axially and radiallay extending engagement surfaces on at least one of the radially inner and radially outer annular edge portions of said first annular member and on at least the corresponding one of the radially inner and radially outer annular edge portions of said second annular member;

(d) engaging said complementary engagement surfaces with one another to dispose said first annular member and said second annular member in a singular selected relative axial and radial position; and (e) forming said toroidal body by respectively sealingly intersecuring said inner edge portions and said outer edge portions of said first and second annular members.

2. The method of claim 1 wherein said providing steps (a) and (b) are performed by providing a duality of annular blanks having oversized cross-sectional areas, and then machining said blanks to form said first and second annular members.

3. The method of claim 2 wherein said step of providing a duality of annular blanks is performed by removing a duality of axial portions from a length of thick-walled tubing.

4. The method of claim 2 wherein said step of providing a duality of annular blanks is performed by using a metal casting process.

5. The method of claim 2 wherein said step of providing a duality of annular blanks is performed by using a metal vacuum forging process.

6. The method of claim 2 wherein said machining step is performed by using a numerically controlled lathe.

7. A method of manufacturing a toroidal pressure vessel for storing high pressure gas used to power a pneumatic control system or the like, said method comprising the steps of:

(a) providing a length of thick-walled metal tubing;
(b) removing a first axial portion of said tubing;
(c) removing a second axial portion of said tubing;
(d) configuring the removed first and second axial portions of said tubing to define complementary semi-torodial sections of a hollow toroidal body having axially offset radially inner and outer annular joint lines and a radially inner wall thickness greater than its radially outer wall thickness;
(e) providing complementary axially and radially extending engagement surfaces on said sections at respective ones of said radially inner and radially outer annular joint lines;
(f) engaging said engagement surfaces to position said sections in a singular axial and radial position relative one another; and
(g) sealingly intersecuring said complementary sections to form said toroidal pressure vessel.

8. The method of claim 7 wherein said configuring step (d) is performed by machining said first and second axial portions of said tubing with a numerically controlled lathe.

9. The method of claim 7 wherein said configuring step (d) includes configuring said complementary sections in a manner such that each has axially offset radially inner and outer annular edge portions, and wherein said intersecuring step (e) is performed by welding the inner edge portion of one of said complementary sections to the inner edge portion of the other of said complementary sections, and welding the outer edge portion of one of said complementary sections to the outer edge portion of the other of said complementary sections.

10. The method of claim 7 further comprising the steps, performed prior to said intersecuring step (e), of forming an opening through one of said complementary sections, providing an outlet fitting, inserting said outlet fitting through said opening, and internally welding said outlet fitting to said one of said complementary sections.

11. The method of claim 7 wherein one of said complementary sections has an interior surface, and wherein said method further comprises the step of providing said pressure vessel with a predetermined, precisely positioned burst location by forming a depression in said interior surface.

12. The method of manufacturing a toroidal pressure vessel comprising the steps of:

providing a first annular member configured to define an axial extending and radially inner portion of a hollow toroidal body and having in transverse section generally a C-shape to define a pair of annular edge portions which are offset relative one another both axially and radially;

providing a second annular member configured to define an axially extending and radially outer portion of a hollow toroidal body and having in transverse section generally a C-shape to define a respective pair of annular edge portions which are offset relative one another both axially and radially in cooperable relation with said pair of edge portions of said first annular member, providing complementary axially and radially extending engagement surfaces on each of said annular edge portions to define one-half of a bell-and-spigot joint for both the radially inner ones of said annular edge portions and for the radially outer ones of said annular edge portions, interengaging said complementary engagement surfaces of said radially inner ones of said annular edge portions and of said radially outer ones of said annular edge portions to complete said bell-and-spigot joints holding said first and said second members in a singular axial and radial relative position, and sealingly securing said interengaged radially inner and radially outer annular edge portions.

13. The method of claim 12 further including the step of providing relatively angled annular external surfaces on each of said first and said second annular member adjacent said engagement surfaces, and employing said relatively angled annular surfaces to cooperatively define a respective annular weld channel outwardly of said bell-and-spigot joints.

14. The method of claim 13 further including welding said interengaged annular members at said bell-and-spigot joints therebetween to both fill said annular weld channels and to fusingly through-melt and thereby further unite said first and second annular member and to obliterate said bell-and-spigot joints thereof.

* * * * *

UNITED STATES PATENT AND TRADEMARK OFFICE

CERTIFICATE OF CORRECTION

PATENT NO. : 4,790,472

DATED : December 13, 1988

INVENTOR(S) : BELA BUNKOCZY

It is certified that error appears in the above-identified patent and that said Letters Patent is hereby corrected as shown below:

Claim 1, line 14 (column 8, line 37) correct spelling of "radiallay" to -- radially --.

Drawings, sheet 1 of 2, insert correct drawing Figures, as follow: 2, 4, 9B, 10B

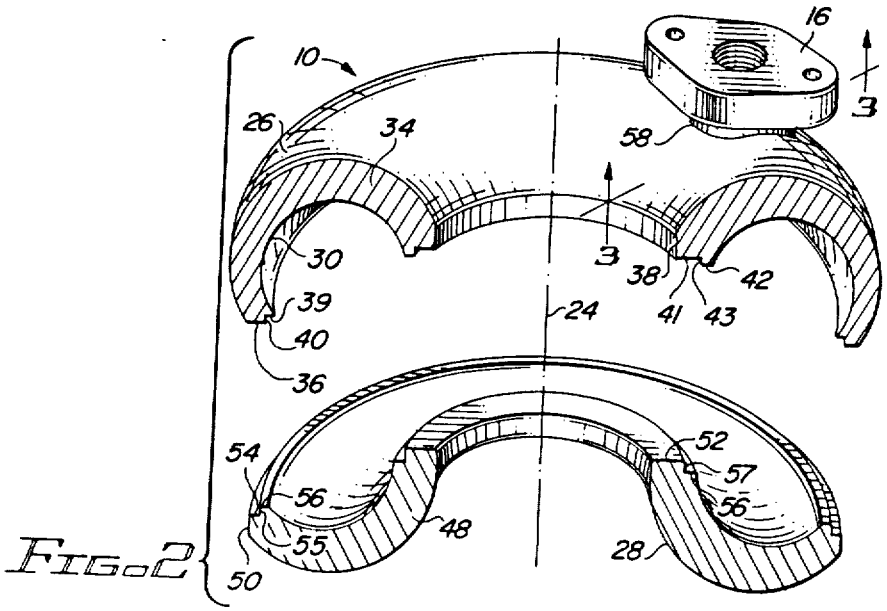

FIG. 2

UNITED STATES PATENT AND TRADEMARK OFFICE

CERTIFICATE OF CORRECTION

PATENT NO. : 4,790,472

DATED : December 13, 1988

INVENTOR(S) : BELA BUNKOCZY

It is certified that error appears in the above-identified patent and that said Letters Patent is hereby corrected as shown below:

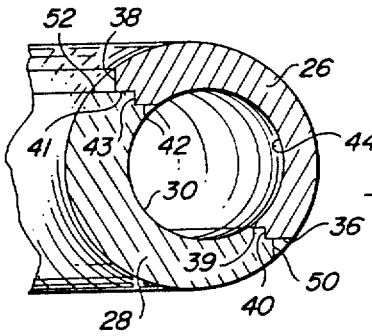

FIG. 4

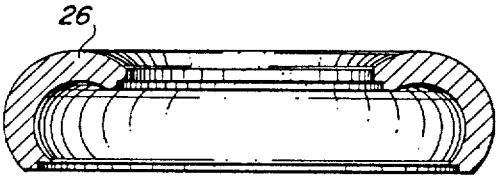

FIG. 9B

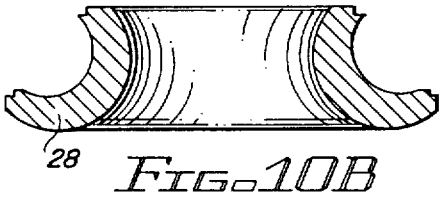

FIG. 10B

Signed and Sealed this

Fourth Day of July, 1989

*Attest:*

*Attesting Officer*

DONALD J. QUIGG

*Commissioner of Patents and Trademarks*